United States Patent [19]

Matson

[11] Patent Number: 4,817,551

[45] Date of Patent: Apr. 4, 1989

[54] BOAT MOORING DEVICE

[76] Inventor: Carl Matson, 10953 Rivercrest Dr., Little Rock, Ark. 72212

[21] Appl. No.: 64,511

[22] Filed: Jun. 22, 1987

[51] Int. Cl.[4] ..... B63B 21/00

[52] U.S. Cl. ..... 114/230; 267/74

[58] Field of Search ..... 114/230, 213, 215, 216; 267/74, 153

[56] References Cited

U.S. PATENT DOCUMENTS

| | | | |
|---|---|---|---|
| 1,690,957 | 11/1928 | Tommins | 267/74 |
| 2,552,424 | 5/1951 | Gorman | 114/230 |
| 2,771,053 | 11/1956 | Gustafson | 114/230 |
| 3,139,852 | 7/1964 | Morris | 114/230 |
| 4,143,613 | 3/1979 | Paul | 114/230 |
| 4,144,831 | 3/1979 | Heydolph | 114/230 |
| 4,250,827 | 2/1981 | Booker et al. | 114/230 |
| 4,261,279 | 4/1981 | Johnson | 114/220 |
| 4,597,351 | 7/1986 | Brainard, II | 114/230 |

FOREIGN PATENT DOCUMENTS

| | | | |
|---|---|---|---|
| 546204 | 9/1957 | Canada | 114/213 |

*Primary Examiner*—Sherman D. Basinger

*Attorney, Agent, or Firm*—Emrich & Dithmar

[57] ABSTRACT

A device for mooring small boats includes a rigid tubular sleeve with outwardly flared ends. A stretch cord located in the sleeve has attaching members in the form of hooks or the like at each end which extend at least partially outside the associated sleeve end. To moor a boat, one hook is pulled outwardly, stretching the cord, and fastened to a boat rail or cleat. The other hook is similarly fastened to a ring or eye-bolt on the dock. The stretch cord urges the hooks toward the sleeve so that the hooks and flared sleeve ends cooperate to form grips; and the sleeve acts as a spacer to space the boat from the dock.

6 Claims, 1 Drawing Sheet

BOAT MOORING DEVICE

BACKGROUND OF THE INVENTION

The present invention relates to apparatus for mooring small boats; and more particularly, it relates to an economical, easy-to-use device which is adapted to moor a small boat at a fixed spacing from a dock so that the boat does not get scratched or otherwise damaged while it is moored.

Devices are known for mooring boats to docks, the most popular mooring device being a fender which is interposed between the boat and the dock. The use of fenders is not always reliable in that the fenders can become displaced so that the side of the boat scrapes against the dock, and they also require that the boat be tied securely and reliably to the dock with a line. Inexperienced boaters many times have difficulty in properly securing boats to docks, particularly in rough weather or for very brief intervals, where less attention is paid to the mooring procedure.

There are also devices for securing boats, including small boats, to docks wherein the boat is spaced from the dock by means of a link which may either be rigid or telescoping, but in most such cases, special fittings are required both for the boat and the dock in order to attach the links. These devices are easier to use but many small boaters, particularly those used by fishermen, are moored at rented slips or at marina facilities only for a short time so that no special attachments are available for receiving these fixed-space mooring devices.

SUMMARY OF THE INVENTION

The present invention includes a rigid tubular sleeve, preferably having outwardly flared opposing end portions. A stretch strap or cord is located within the sleeve and has attaching members, which may be hooks or the like, at each end of the cord. The hooks extend at least partially out of the associated flared sleeve end so that they may be grasped with one hand while the sleeve is held in the other hand. The hook is then pulled slightly outwardly of the sleeve and coupled to a connector, such as a cleat or rail, on the boat.

Similarly, the opposing hook is pulled out of the spacer sleeve and coupled to a similar connector, hook, eye-bolt or cleat on the dock.

The stretch cord acts to retract both hooks after they are attached respectively to the boat and the dock. Thus, the distal hook draws the connector on the boat inwardly to engage the flared end of the tube; and the opposing flared end engages the connector on the dock. The tube remains in compression and defines the limit beyond which the boat may not approach the dock, although if someone steps into the boat or water conditions are rough, the device provides a cushion mount for movement of the boat away from the dock.

The apparatus of the present invention is thus very economical and uses devices easily understood and applied by even a novice boater, yet once applied, the device provides a reliable attachment for spacing the boat from the dock. Moreover, the device can be completely removed from the dock and the boat and is easily stored on the boat. It eliminates the need for storage space for bulky fenders, and it also eliminates the need for some expertise in tying lines to the boat and to the dock.

Various configurations for using the invention to prevent longitudinal as well as lateral movement of the boat during docking are disclosed.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF THE PREFERRED EMBODIMENT

Figure 1:
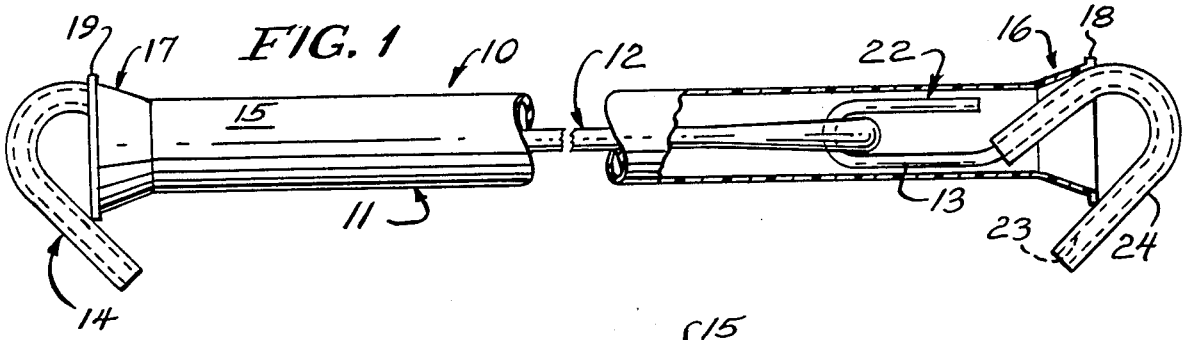
FIG. 1 is a side view of a device incorporating the present invention, partly in vertical cross section, and with the center portion broken away for foreshortening.

Turning now to the drawing, a docking device constructed according to the present invention is generally designated 10. It includes, principally, a rigid tubular sleeve 11, an elastic stretch cord generally designated 12, and first and second attaching hooks 13, 14.

The sleeve 11 comprises a central tubular section 15 of generally constant diameter and first and second flared end portions 16, 17. The outboard ends of the flared sections 16, 17 also include peripheral flanges designated 18 and 19 respectively.

The tubular sleeve 15 is rigid in the sense that it should resist any compression under the normal forces encountered in use, which, of course, depend upon the size of the boat and the conditions of use. The device, however, is preferably intended for use with lighter boats of the type popularly used by fisherman and pleasure boaters. The tubular sleeve 11 may be made of a rigid plastic, such as polyvinyl chloride, having a nominal wall thickness of approximately 0.030 in.

Figure 2:
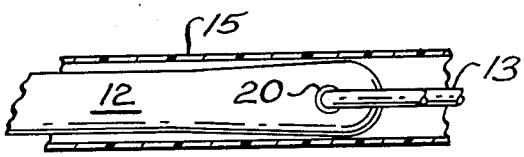
FIG. 2 is a fragmentary close-up view taken from the top as seen in FIG. 1 and showing the attachment of the hook to the stretch cord.

The stretch cord 12 is a conventional elastic rubber cord of the type commonly referred to as "tarp straps" and are used to tie down tarpolins and the like to trucks. At each end of the stretch cord 12 there is a grommet 20 which receives the base of the hook 13 as best seen in FIG. 2. The other end of the stretch cord is similarly connected to the other hook 14.

Each of the hooks 13, 14 may be similar in shape. Referring to the hook 13, it includes a first U-shaped section generally designated 22 for attaching to one end of the stretch cord 12; and a second U-shaped section 23 over which a protective plastic sheath 24 is fitted.

The shape of the U-shaped section 23 of the hook 13 (which is sometimes referred to as an "attaching means") is sufficient to fit over the shank of a boat cleat or to be received in an eye-bolt or to be coupled to the rail of a boat.

Figure 3:
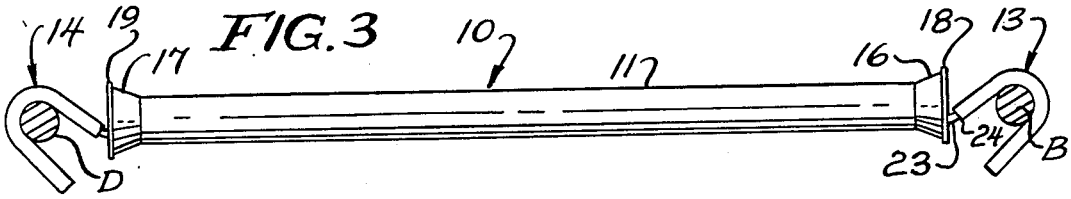
FIG. 3 illustrates how the device is used to attach to a boat and a dock.
Figure 4:
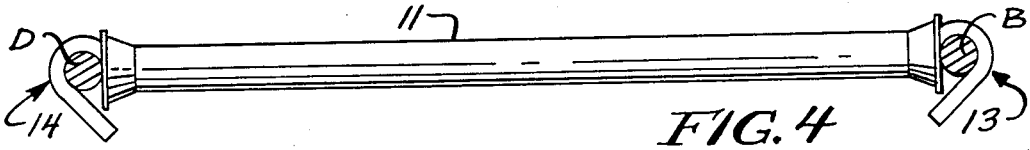
FIG. 4 shows the attachment of boat and dock complete.

Turning now to FIG. 3, B represents a connector on the boat; and D represents a connector on the dock. Both connectors are shown in cross-section, and they need take no special form or shape. The connectors B, D could be the shank of a cleat, a rail, an eye-bolt, a U-bolt or any other connecting device secured respectively to the boat and dock capable of being received in the U-shaped sections of the attaching hooks 13, 14 respectively. It is not even necessary that the connectors B and D have their axes parallel since one of the attaching hooks can readily be turned 90° relative to the other.

To attach the hook 13 to the connector B, the hook is simply pulled with one hand while grasping the sleeve 11 with the other hand and the U-shaped attaching portion 23 is placed around the connector B and the hook may then be released.

Similarly, the hook 14 is pulled from the tubular sleeve 11 with a similar action and fitted around the connector D on the dock. When the hooks are released, the stretch cord 12 urges them inwardly toward the "home" position and the connectors B and D are secured within the respective hooks and engaged by the abutment flanges 18, 19 of the respective flared end portions 16, 17 of the tubular sleeve 11.

Preferably, the stretch cord or strap 12 has a slight tension or preload even in the normal position so that when the hooks are in the home position, they are received in the flared end sections of the sleeve and the U-shaped attaching section of the hook abuts its associated peripheral flange in the limit position. However, the preload on the stretch cord 12 is not so great as to make it difficult to withdraw the hook from the sleeve in attaching it to a connector.

Figure 5:
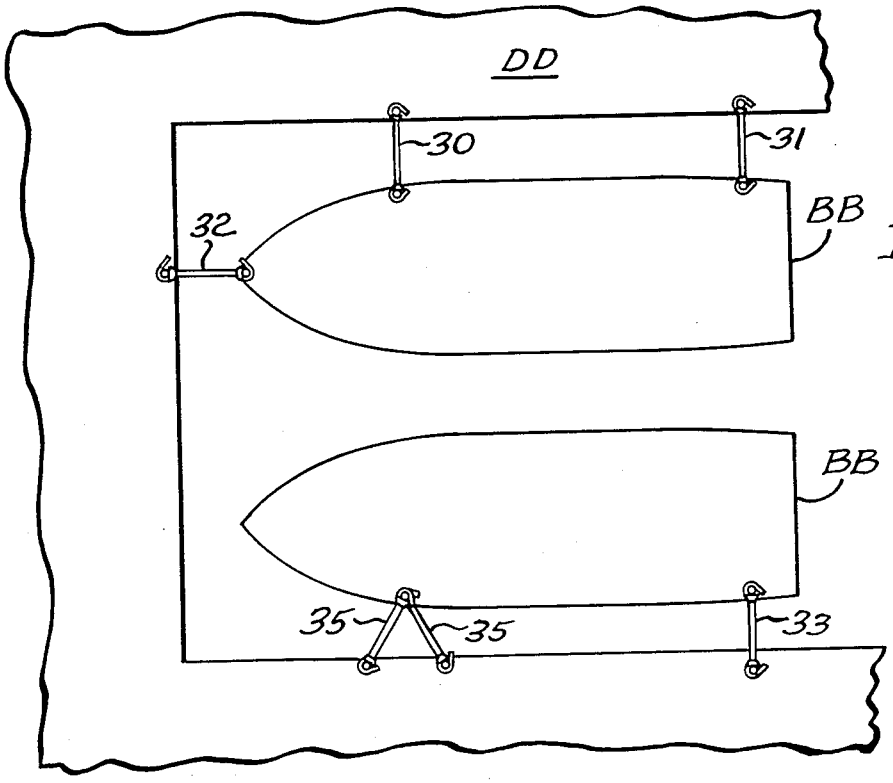
FIG. 5 illustrates various ways to use the invention to secure a boat to a dock.

Turning now to FIG. 5, there are shown two different ways of securing a boat, diagrammatically represented by the outlines BB to a dock DD which spaces the boat from the dock to prevent lateral motion and which are also connected to the dock to prevent longitudinal motion. At the top of FIG. 5, two of the connecting devices are designated 30 and 31 respectively, and they connect a side of the boat BB to the dock DD at spaced positions; and a third attaching device 32 connects the bow of the boat to the dock.

In the lower portion of FIG. 5, a first connecting device 33 attaches the side of the boat to the dock near the stern of the boat; and two forward connecting devices 34, 35 connect a common point of the boat near the bow of the boat to spaced locations on the dock so that the forward connectors form a "A" or inverted "V".

In addition to many different sizes and shapes for the attaching device, as well as different materials for the sleeve, there are many different kinds of shock cord materials or elastic straps that will serve the intended purpose of the one disclosed. Moreover, there are many different kinds of hooks or attaching means, which will serve the intended purpose, such as U-shaped hooks as illustrated. Equally suitable are grapple-type hooks or split hooks or snap hooks. The device may also be designed to accomodate larger boats by strengthening the hooks and spacer and by using multiple stretch cords or coil springs.

It will thus be appreciated that the present invention is easy to use in temporarily securing a boat to a dock, even by a novice since it employs simple components well-known to most users. Moreover, it is an inexpensive device which is flexible in use and requires no special adaptation either to the boat or to the dock, and may fasten to any number of connecting devices. Moreover, the apparatus acts as a cushion against outward movement of the boat relative to the dock connector, and the device may be completely removed from the dock and the boat and, where more than one device is used, they may be stored side-by-side in a relatively small space.

Having thus disclosed in detail a preferred embodiment of my invention as well as alternatives thereof, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. Apparatus for mooring one or two adjacent sides of a boat to a dock without the need for mooring connectors on the opposite sides of said boat, said boat having a first connector, and said dock having a second connector, said apparatus comprising: a rigid tubular sleeve having first and second open ends; stretchable tension means in said sleeve; first and second releasable attaching means fastened respectively at the respective ends of said tension means; said first and second attaching means extending at least partially out of the associated open ends of said sleeve whereby said first and second attaching means may be pulled from said tube and releasably coupled respectively to said first and second connectors, and said tension means will urge said first and second attaching means respectively against opposing ends of said sleeve thereby to place said rigid sleeve under compression to space said boat from said dock at a fixed distance determined by the length of said sleeve.

2. The apparatus of claim 1 wherein said stretchable tension means has a preloaded tension when said attaching means are at their respective normal positions, whereby said tension means urges said first and second attaching means into limiting engagement with the respective ends of said sleeve.

3. The apparatus of claim 2 wherein said tension means comprises a strap of elastomeric rubber.

4. The apparatus of claim 1 wherein said sleeve is made of plastic and includes at each open end an outwardly flared portion for enlarging the diameter thereof for receiving an associated attaching means.

5. The apparatus of claim 4 further comprising a peripheral flange at the outboard end of each of said flared sections of said sleeve for providing a bearing surface for engaging an associated connector when said attaching means are coupled thereto.

6. The apparatus of claim 1 wherein said first and second attaching means include a U-shaped hook portion adapted to fit around a connector and having a distal end extending beyond the open end of said sleeve thereby to secure said connector into abutting relation with the open end of said sleeve when said sleeve is in use, and limiting the insertion of said attaching means into said sleeve when said apparatus is not in use.

* * * * *